United States Patent [19]

Perry et al.

[11] Patent Number: 4,848,211

[45] Date of Patent: Jul. 18, 1989

[54] COMPOSITE DEFLECTING ARMOUR

[75] Inventors: Melvyn Perry, Wetherby; John H. T. Brewer, Harrogate; Derek S. Stocks, Tingley, all of England

[73] Assignee: Royal Ordnance plc, London, England

[21] Appl. No.: 130,286

[22] Filed: Dec. 8, 1987

[51] Int. Cl.[4] ..... B32B 15/04; B32B 23/02; F41H 5/00; F41H 5/04

[52] U.S. Cl. ..... 89/36.02; 428/192; 428/40 E; 428/465; 428/466; 428/911; 428/683; 109/82

[58] Field of Search ..... 428/457–463, 428/465, 466, 911, 683, 192; 109/49.5, 82, 83, 79, 84; 114/9, 10; 89/36.02, 36.08, 36.13

[56] References Cited

U.S. PATENT DOCUMENTS

| | | | |
|---|---|---|---|
| 3,962,976 | 6/1976 | Kelsey | 109/82 |
| 3,969,563 | 7/1976 | Hollis, Sr. | 428/920 |
| 4,426,429 | 1/1984 | Di Russo et al. | 428/654 |
| 4,533,183 | 8/1985 | Gant | 301/37 TC |
| 4,548,414 | 10/1985 | Denis | 273/359 |
| 4,757,742 | 7/1988 | Mazelsky | 109/79 |

*Primary Examiner*—Marion C. McCamish
*Assistant Examiner*—Jill M. Gray
*Attorney, Agent, or Firm*—Stevens, Davis, Miller & Mosher

[57] ABSTRACT

A composite armour comprises an outer layer of metal, an inner layer of metal, and therebetween an intermediate non-metallic layer, wherein there is provided along an edge of the intermediate layer a deflecting strip of metal, said deflecting strip presenting towards the edge of the intermediate layer a face which is inclined at an oblique angle with respect to the surface of the inner layer.

6 Claims, 1 Drawing Sheet

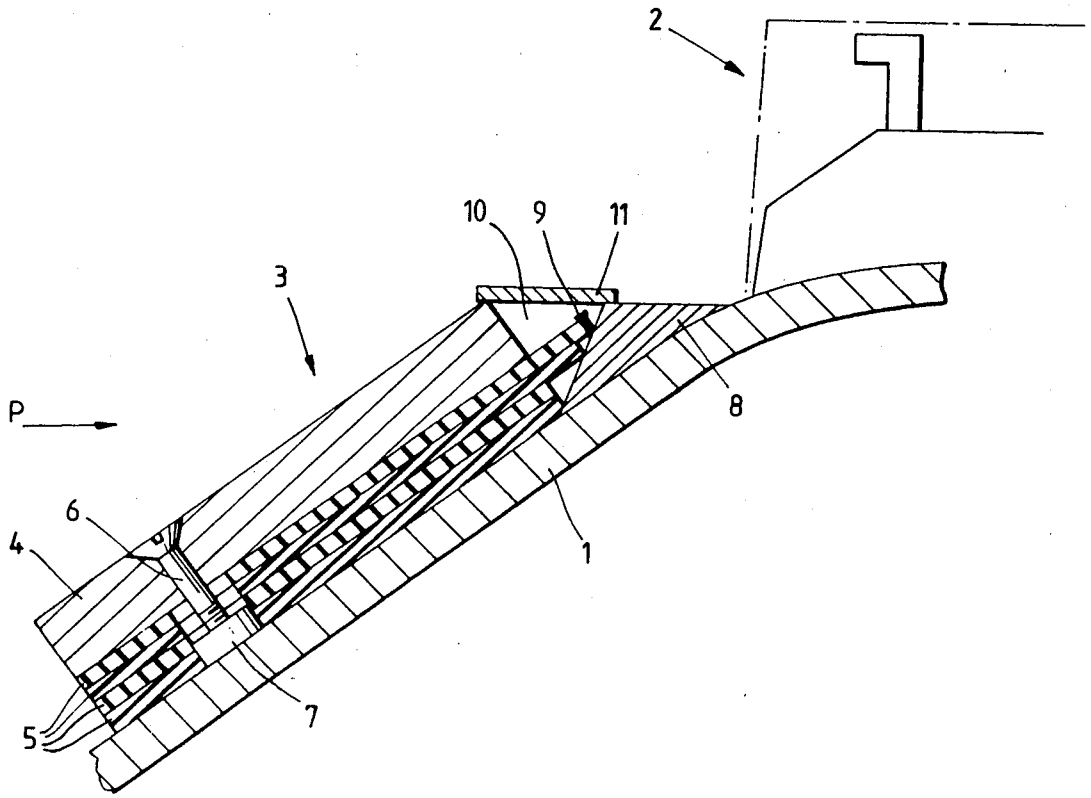
2
3
P
10
9
11
8
1
7
6
4
5

COMPOSITE DEFLECTING ARMOUR

FIELD OF THE INVENTION

This invention relates to composite armour of the kind comprising one or more non-metallic layers sandwiched between two metallic layers. Such armour can be very effective on a weight for weight basis as compared with conventional homogeneous armour plate against projectiles, missiles and the like herein called collectively "weapons" utilising kinetic energy and/or chemical energy.

It can happen, however, that spall from the forward layer of armour plate, or possibly fragments of the penetrator of the weapon, while not penetrating through the whole armour structure, may become redirected parallel to the layers, within the non-metallic layer. Such fragments may possess high residual energy, and may meet with relatively little resistance within the non-metallic layer.

The geometry of the vehicle or other installation which the armour is intended to protect may be such that unprotected components lie within the plane of the non-metallic layer. Unless further steps are taken to contain these redirected fragments, the armour may thus itself serve to redirect high energy spall or penetrator fragments towards unprotected components. This may occur for example in the case of a tank turret where the plane of the lower armour plates may intersect components above such as hatches, machine guns, or periscopes for example which by their nature it is not possible fully to protect with surrounding armour.

There is therefore a need for a means to protect these exposed components against damage resulting from spall, etc., which is redirected by lower armour plates.

SUMMARY OF THE INVENTION

Accordingly the present invention provides a composite armour comprising an outer layer of metal, an inner layer of metal, and therebetween an intermediate non-metallic layer, wherein there is provided along an edge of the intermediate layer a deflecting strip of metal, said deflecting strip presenting towards the intermediate layer a face which is inclined at an oblique angle with respect to the surface of the inner layer.

The deflecting strip may comprise one face of a 'ski jump' form of a projection of triangular cross-section formed on the inner layer. The projection may for example comprise a welded triangular metal section.

Any fragments which are directed along the plane of the intermediate layer towards the deflecting strip will thus on impact with the said face be deflected outwardly away from the plane of the layers of armour. The angle of inclination of the said face is so chosen as to deflect such fragments clear of any unprotected components lying within or forward of the plane of the intermediate layer.

There is preferably provided a space between the deflecting strip and the outer layer of metal through which deflected fragments may pass.

The said space may be covered by a light cover plate which is designed to be friable under the attack of large calibre weapons, but to remain undisturbed under the attack of smaller weapons.

BRIEF DESCRIPTION OF THE DRAWING

The invention will now be described by way of example only with reference to the accompanying drawing which shows in sectional elevation a composite armour in accordance with the invention as applied to a tank turret.

DETAILED DESCRIPTION OF THE PREFERRED EMBODIMENT

As shown in the drawing a tank turret comprises a steel body structure 1 which also constitutes the inner metal layer of the composite armour in accordance with the invention. The tank turret also comprises unprotected components as indicated diagrammatically within the chain line 2.

The lower portion of the turret is protected by composite applique armour, of which one section is shown at 3. This section comprises an outer metal layer 4 of rolled homogeneous armour plate, and four non-metallic layers 5 of flame retardant nitrile rubber. These rubber layers are vulcanised one to another and to the body structure 1 and the outer layer 4. The structure is additionally held together by means of countersunk stainless steel screws 6 which are received in threaded mild steel bosses 7 welded to the body structure 1.

Along the edges of the rubber layers 5 there is provided a deflecting strip 8 of triangular cross-section, having a face 9 inclined obliquely to the surface of the body structure 1. The strip 8 is of mild steel and is welded along its length to the body structure 1. The plane of the face 9 passes outside the unprotected components within the chain line 2.

A space 10 is left between the strip 8 and the outer layer 4, and this space is closed by a light cover plate 11 of mild steel, stitch welded to the strip 8 and to the outer layer 4 along its length.

When the composite armour is attacked by a projectile such as a kinetic energy penetrator or a chemical energy penetrator such as a shaped charge, the composite structure provides exceedingly good resistance to penetration on a weight for weight basis, as opposed to conventional homogeneous armour. However, it is likely that fragments of spall or penetrator may enter the space occupied by the intermediate rubber layers 5, and some may be directed along their plane towards the zone enclosed by the chain line 2. In the absence of the deflector 8, such fragments could do substantial damage to the components within this zone.

However, the deflector ensures that such fragments are directed away from this zone, into the space 10. If the fragments are of relatively low energy, such as may result from attack by a hand held weapon, then they will probably be contained by the light plate 11, and there will thus be no possibility of damage to personnel or equipment. If they possess higher energy, as in the case of larger weapons, then the light plate 11 will attenuate their energy. In any case, damage within the zone defined by the chain line 2 is avoided.

We claim:

1. A composite armour comprising an outer layer of metal, an inner layer of metal, and therebetween at least one intermediate non-metallic layer, a deflecting strip of metal provided along an edge of said intermediate layer and welded to said inner layer, and a covered space extending between said deflecting strip and said outer layer, said deflecting strip having a face which is inclined at an oblique angle with respect to the surface of said inner layer.

2. A composite armour according to claim 1 wherein the said space is covered by a light cover plate.

3. A composite armour according to claim 2 wherein the cover plate is secured to the deflecting strip and to the outer layer by stitch welding.

4. A composite armour according to claim 1 wherein the outer layer is of rolled homogeneous armour steel.

5. A composite armour according to claim 1 wherein the inner and outer layers are held together by means of screws which are received in bosses welded to the inner layer.

6. A composite armour according to claim 5 wherein the screws are of stainless steel and the bosses are of mild steel.

* * * * *

UNITED STATES PATENT AND TRADEMARK OFFICE

CERTIFICATE OF CORRECTION

PATENT NO. : 4,848,211

DATED : July 18, 1989

INVENTOR(S) : GRANELLI et al.

It is certified that error appears in the above-identified patent and that said Letters Patent is hereby corrected as shown below:

On the title page, under item [19], "Perry et al." should read --Granelli et al.--

In the heading of the patent please change the following:

--[75] Mario L. GRANELLI, Leeds; Melvyn PERRY, Wetherby; John H.T. BREWER, Harrogate; Derek S. STOCKS, Tingley; all of England --

Signed and Sealed this

Twenty-second Day of January, 1991

*Attest:*

HARRY F. MANBECK, JR.

*Attesting Officer*

*Commissioner of Patents and Trademarks*